US011827426B2

(12) United States Patent
Morren et al.

(10) Patent No.: US 11,827,426 B2
(45) Date of Patent: Nov. 28, 2023

(54) VALVE CARRIER RING FOR SELF-CLOSING DISPENSING VALVE

(71) Applicant: Weener Plastics Group B.V., Ede (NL)

(72) Inventors: Jacobus Jan Morren, Ede (NL); Annabel Hoekstra, Zwolle (NL); Sebastiaan Wilhelmus Josephus Den Boer, Twello (NL)

(73) Assignee: Weener Plastics Group B.V., Ede (NL)

( * ) Notice: Subject to any disclaimer, the term of this patent is extended or adjusted under 35 U.S.C. 154(b) by 0 days.

(21) Appl. No.: 17/422,239

(22) PCT Filed: Jan. 13, 2020

(86) PCT No.: PCT/NL2020/050017
§ 371 (c)(1),
(2) Date: Jul. 12, 2021

(87) PCT Pub. No.: WO2020/149738
PCT Pub. Date: Jul. 23, 2020

(65) Prior Publication Data

US 2022/0089335 A1 Mar. 24, 2022

(30) Foreign Application Priority Data

Jan. 14, 2019 (NL) ..... 2022396

(51) Int. Cl.
*B65D 47/20* (2006.01)

(52) U.S. Cl.
CPC ..... *B65D 47/2031* (2013.01)

(58) Field of Classification Search
CPC ..... B65D 47/2031; B65D 47/0823; F16K 15/144; F16K 15/145; F16K 15/1472
See application file for complete search history.

(56) References Cited

U.S. PATENT DOCUMENTS 5,033,655 A * 7/1991 Brown ..... B29C 66/542 285/423
5,115,950 A * 5/1992 Rohr ..... B65D 47/2031 222/212

(Continued)

FOREIGN PATENT DOCUMENTS

| | | | |
|---|---|---|---|
| EP | 1 802 533 | B1 | 11/2008 |
| EP | 2 106 369 | A2 | 10/2009 |
| WO | 2008/091490 | A2 | 7/2008 |

OTHER PUBLICATIONS

Preformed_Definition_Meaning _-_ Merriam-Webster.pdf; obtained on Apr. 23, 2022 from: https://www.merriam-webster.com/dictionary/preformed.*

(Continued)

*Primary Examiner* — Donnell A Long
*Assistant Examiner* — Randall A Gruby
(74) *Attorney, Agent, or Firm* — Hoffmann & Baron, LLP

(57) ABSTRACT

A valve carrier ring for carrying a self-closing dispensing valve is adapted to be assembled with a closure body of a container. The valve carrier ring includes an annular seat portion including a support surface for supporting a retaining portion of the valve and a circumferential wall located radially outwards of the support surface and extending coaxially with the support surface. The circumferential wall has a preformed radial protrusion adapted to extend over the retaining portion of the valve for providing a preliminary retention of the retaining portion in the seat portion. A snap bead is formed at a radial outer side of the valve carrier ring adapted to cooperate with a means of the closure body to provide a snap connection between the valve carrier ring and the closure body. The radial protrusion is constituted by a flexible inwardly inclined extremity of the circumferential wall.

4 Claims, 5 Drawing Sheets

(56) References Cited

U.S. PATENT DOCUMENTS 5,409,144 A * 4/1995 Brown ..... B65D 47/2031 222/496
5,632,420 A * 5/1997 Lohrman ..... B65D 47/2031 222/212
5,904,275 A * 5/1999 Suffa ..... B65D 47/2037 222/525
6,006,960 A * 12/1999 Gross ..... B65D 47/0809 222/545
6,405,901 B1 * 6/2002 Schantz ..... B65D 47/2031 222/490
6,786,363 B1 * 9/2004 Lohrman ..... B65D 47/0804 222/546
7,980,430 B2 * 7/2011 Hickok ..... B65D 47/2031 222/490
8,397,956 B2 * 3/2013 Olechowski ..... B65D 47/2031 222/490
8,397,958 B2 * 3/2013 Smith ..... B65D 47/2031 222/105
8,640,928 B2 * 2/2014 Ellenkamp-Van Olst ..... F16K 15/147 222/545
8,733,600 B2 * 5/2014 Pritchard ..... B65D 75/5877 222/541.9
8,978,939 B2 * 3/2015 Bull ..... B65D 47/2031 222/490
9,340,335 B2 * 5/2016 Ellenkamp-Van Olst ..... B29C 66/5344
9,682,804 B2 * 6/2017 Hatton ..... B65D 47/2025
10,259,623 B2 * 4/2019 Bull ..... B65D 51/224
10,518,943 B2 * 12/2019 Gelov ..... B65D 35/08
10,836,541 B2 * 11/2020 Proudfoot ..... F16K 15/147
11,390,442 B2 * 7/2022 Nini ..... B65D 77/067
2006/0249545 A1 * 11/2006 Ramsey ..... B65D 47/2031 222/494
2007/0295765 A1 * 12/2007 Bull ..... B65D 47/2031 222/494

OTHER PUBLICATIONS

Preliminary_Definition_Meaning _-_ Merriam-Webster.pdf; obtained on Apr. 23, 2022 from: https://www.merriam-webster.com/dictionary/preliminary.*

* cited by examiner

VALVE CARRIER RING FOR SELF-CLOSING DISPENSING VALVE

CROSS-REFERENCE TO RELATED APPLICATIONS

This application is the National Stage of International Application No. PCT/NL2020/050017, filed Jan. 13, 2020, which claims the benefit of Netherlands Application No. 2022396, filed Jan. 14, 2019, the contents of which is incorporated by reference herein.

FIELD OF THE INVENTION

The present invention relates to a valve carrier ring for carrying a self-closing dispensing valve and adapted to be assembled with a closure body of a container. The self-closing dispensing valve comprises a valve head having a dispensing orifice, a peripheral retaining portion and a connecting portion interconnecting the valve head and the retaining portion. The valve carrier ring comprises an annular seat portion comprising a support surface for supporting the retaining portion of the valve and a circumferential wall located radially outwards of the support surface and extending coaxially with the support surface. The circumferential wall has a preformed radial protrusion adapted to extend over the retaining portion of the valve, thereby providing a preliminary retention of the retaining portion in the seat portion. A snap bead is formed at a radial outer side of the valve carrier ring adapted to cooperate with snap means of the closure body to provide a snap connection between the valve carrier ring and the closure body.

BACKGROUND ART

EP 2106369 discloses a valve carrier ring made as a unitary structure of a thermoplastic material by injection moulding. The carrier ring comprises a tubular wall which defines a dispensing passage. The carrier ring furthermore comprises a seat portion for the retaining portion of the valve on an end of the tubular wall. The seat portion has a circumferential wall which is coaxial with the tubular wall. On the outside of the circumferential wall a circumferential snap bead is formed to cooperate with a snap bead in the closure body to attach the carrier ring to the closure body. At least one retaining bead is formed on the inner side of the circumferential wall and protrudes radially inwards. The retaining bead thus forms an undercut which defines a retaining space for the retaining portion of the valve. The retaining beads provide a preliminary retention of the retaining portion of the valve in the seat portion, before the assembly of the carrier ring and the valve is mounted in a closure of a container. The circumferential wall is attached to the tubular wall by a bridge, however at the location of the retaining space(s) the circumferential wall is not attached to the tubular wall. Instead there is an opening, which is necessary because the sturdy retaining beads require an injection mould including a steel fixture in one of the mould halves to create the undercut. The undercut-steel fixture thus also forms the opening in the seat portion. When the carrier ring is inserted in the closure body of a closure, it is subjected to a considerable radial compression to push it beyond the snap means of the closure body. A disadvantage of the openings in the seat portion of the carrier ring is that it locally reduces the stiffness of the carrier ring in the radial direction which may lead to a local permanent deformation and consequently a permanent non-circular shape when the carrier ring is radially compressed when snapped in the closure body. A permanent deformation in radial direction can thus have a negative effect on the tightness of the seal formed between the circumferential bead on the outer side of the circumferential wall of the carrier ring and the inner surface of the closure body.

EP 1 802 533 discloses a valve carrier ring without openings in the seat portion thereof. This known carrier ring has no preformed radial protrusion(s) on the circumferential wall, but the circumferential wall is formed as an initially straight annular wall which can be easily demoulded. However to be able to retain the valve in the carrier ring the circumferential wall is designed as a crimping flange capable of being bent from an uncrimped position to a crimped position. After the retaining portion of the valve is placed in the seat portion of the carrier ring, the crimping flange is crimped, thus permanently folded, over the retention portion of the valve to fix the valve in the carrier ring. The assembly of this particular valve carrier ring and the valve thus requires an additional crimping step.

SUMMARY OF THE INVENTION

An object of the present invention is to provide an alternative valve carrier ring.

This object is achieved by a valve carrier ring for carrying a self-closing dispensing valve and adapted to be assembled with a closure body of a container, wherein the self-closing dispensing valve comprises a valve head having a dispensing orifice, a peripheral retaining portion and a connecting portion interconnecting the valve head and the retaining portion, the valve carrier ring comprising an annular seat portion comprising a support surface for supporting the retaining portion of the valve and a circumferential wall located radially outwards of the support surface and extending coaxially with the support surface, wherein the circumferential wall has a preformed radial protrusion adapted to extend over the retaining portion of the valve, thereby providing a preliminary retention of the retaining portion in the seat portion, wherein one or more snap beads are formed at a radial outer side of the valve carrier ring adapted to cooperate with snap means of the closure body to provide a snap connection between the valve carrier ring and the closure body, and wherein the radial protrusion is constituted by a flexible inwardly inclined extremity of the circumferential wall.

The carrier ring of the invention is formed having an inwardly protruding extremity of the circumferential wall in an injection mould. The formed extremity has an inclination angle with respect to the circumferential wall, preferably within a range of 20° to 70°, wherein the angle may also depend on the length of the extremity. The inclined extremity of the circumferential wall provides an undercut needed to be able to retain a valve in the carrier ring. There is no clearance to release this undercut from the mould. Therefore, according to the invention, the inclined extremity of the circumferential wall is designed to be flexible to such an extent that it can be elastically deformed when the carrier ring is released from the mould (core). Because the carrier ring design according to the invention does not have beads formed on the inner side of the circumferential wall, it also does not have the required openings in the valve seat in contrast to the carrier ring disclosed in EP 2106369. Therefore the carrier ring according to the invention provides a stiffer design in radial direction leading to a more reliable seal between the circumferential snap bead of the carrier ring and the inner surface of the closure body.

In a preferred embodiment the extremity is constituted by multiple flexible fingers mutually spaced apart and distributed over the circumference.

In another possible embodiment the extremity is formed as a continuous flexible lip extending over the entire circumference.

Another aspect of the invention relates to a valve assembly comprising a valve carrier ring as set out in the above and a self-closing dispensing valve comprising a valve head having a dispensing orifice, a peripheral retaining portion and a connecting portion interconnecting the valve head and the retaining portion, wherein the retaining portion is formed as a ring having a circumferential surface, which in an assembled state faces the circumferential wall of the carrier ring, said circumferential surface having a tapering shape, wherein the radially most inwards edge of the inclined extremities of the circumferential wall of the carrier ring define a circular passage for inserting the retaining portion in the seat portion, wherein the smallest outer diameter of the tapering circumferential surface is smaller than or corresponds substantially with the diameter of said circle, and wherein the largest outer diameter of the tapering circumferential surface is larger than the diameter of said circle.

The valve assembly according to this aspect of the invention provides the advantage that the valve and the valve carrier ring can be easily assembled in an automated process. The valves are supplied for example by a conveyor to a predetermined position in which it rests with its retaining portion on a support surface. The smallest outer diameter of the tapering circumferential surface is facing away from the support surface. The carrier ring is orientated with the terminal end portion facing the support surface and is then placed over the retaining portion of the valve, for example by automatic equipment. When the carrier ring is placed over the retaining portion of the valve the radially most inwards edge of the inclined extremities of the circumferential wall slides along the tapering circumferential surface of the retaining portion of the valve and forces the retaining portion inwardly such that it passes into the seat portion, and wherein the retaining portion flexes back. The retaining portion of the valve is now loosely caught in the valve seat by the undercut of the extremity of the circumferential wall.

The invention also relates to a closure assembly for a container, the closure assembly comprising a closure body attachable or attached to a container and a valve assembly as described in the above, wherein the closure body comprises a deck with a dispensing passage and snap means arranged on an inner side of the closure body around the dispensing passage, wherein the snap bead of the valve carrier ring constitutes a snap connection with the snap means of the closure body, and wherein the closure body has an engagement collar coaxial with the dispensing passage, said engagement collar being arranged and configured to abut with an end thereof against the retaining portion of the valve when the carrier ring is snapped in the closure body, thereby urging the retaining portion of the valve in a sealing engagement with the seat portion of the carrier ring.

The invention will be described in more detail in the following detailed description with reference to the drawings.

DETAILED DESCRIPTION OF THE INVENTION

The invention relates to a valve carrier ring which is designed to preliminary retain a self-closing valve, which is used in dispensing closures for containers, for example squeeze bottles, containing substances such as sauces like mayonnaise, ketchup, mustard or the like, but also for example body care products, cleaning products etc.

Such self-closing valves are well known in the art and are made in one piece by injection moulding, usually from a silicone or another suitable elastomer material. This type of valves comprises a valve head having a dispensing orifice, which in general is defined by a number of slits. When the container is pressurized the slits open at a certain threshold pressure. After the pressure is relieved the valve head closes and returns to its original shape automatically due to its elastic nature.

This type of self-closing valves generally also have a retaining portion or in particular a retaining flange, which is adapted to retain the valve in a closure or a carrier ring, often by clamping. The valve head and the retaining portion are interconnected by a connecting portion, often referred to as a connector sleeve.

The valves are flexible and relatively small, i.e. having an outer diameter of 15 mm, but in practice often smaller. These small flexible valves have a tendency to stick together in a collecting container after being produced. Moreover they are difficult to separate and handle in an automatic assembly line where they are mounted in a dispensing closure for/of a container. Therefore, the valves may be assembled first with a valve carrier ring before they are stored and later supplied to an assembly line to assemble it with a closure body of a dispensing closure. The assembly of the valve and the carrier ring can take place on a different site as the assembly of the valve/carrier ring assembly with the closure body.

The valve carrier ring is a rigid part relative to the self-closing valve and is easier to handle than a separate valve. It protects the valve it carries and it prevents interruptions in the automatic assembly line.

Figure 5:
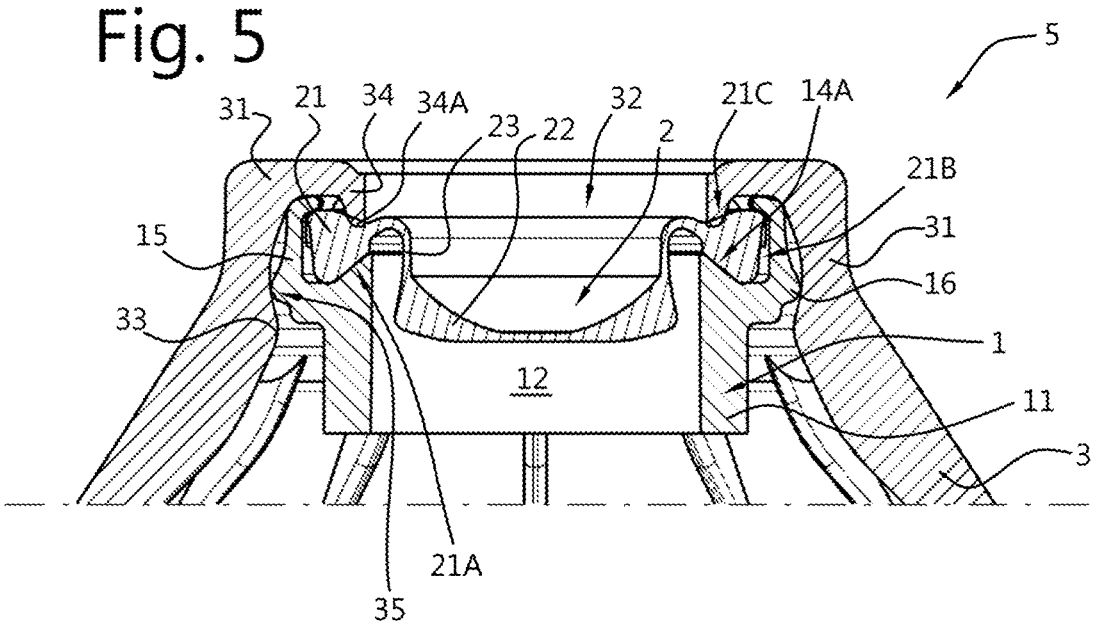
FIG. 5 shows a cross section of the valve carrier ring of FIG. 1 assembled with a valve and mounted in a closure for a container.
Figure 6:
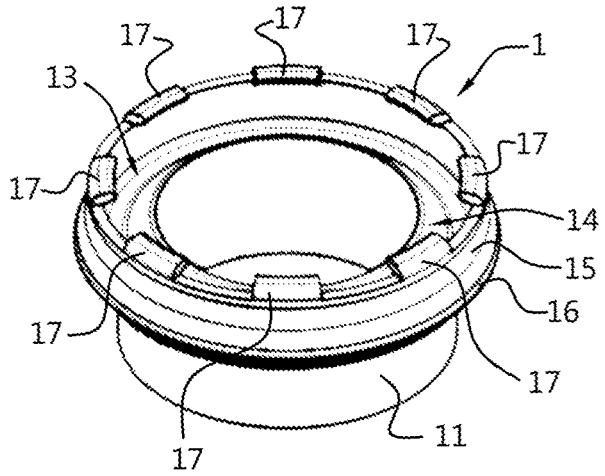
FIG. 6 shows a view in perspective of another embodiment of a valve carrier ring according to the invention.
Figure 7:
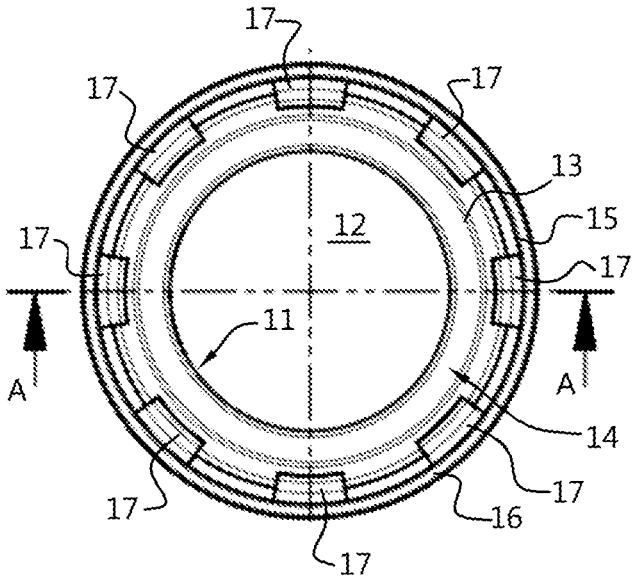
FIG. 7 shows a top elevational view of the valve carrier ring of FIG. 6.
Figure 8:
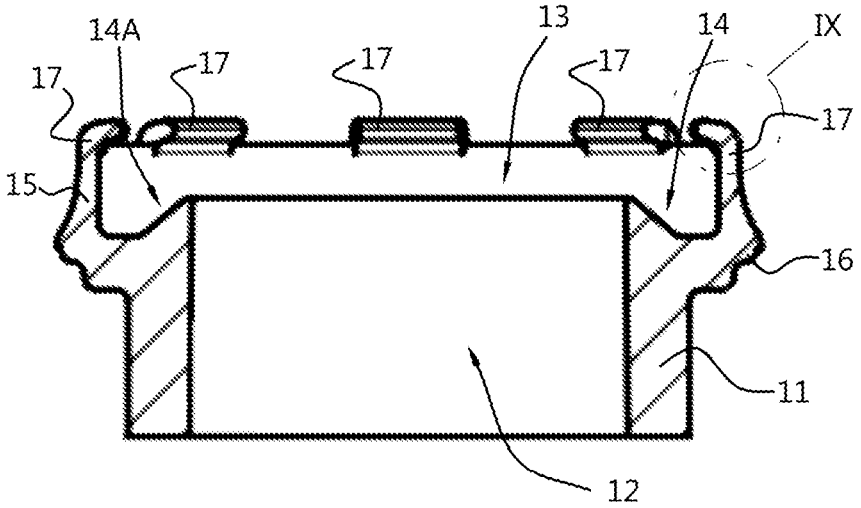
FIG. 8 shows a cross section according to A-A indicated in FIG. 7.
Figure 9:
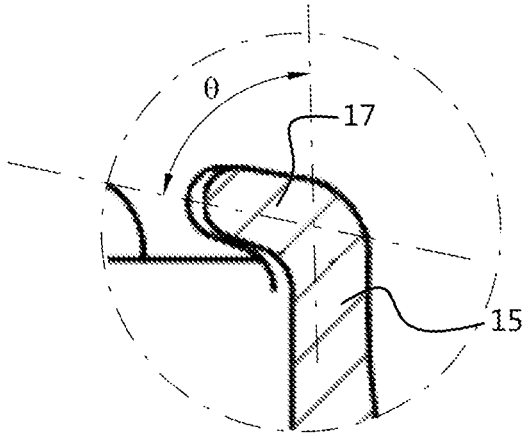
FIG. 9 shows a detail of the valve carrier ring as is indicated in FIG. 8 with IX.
Figure 11:
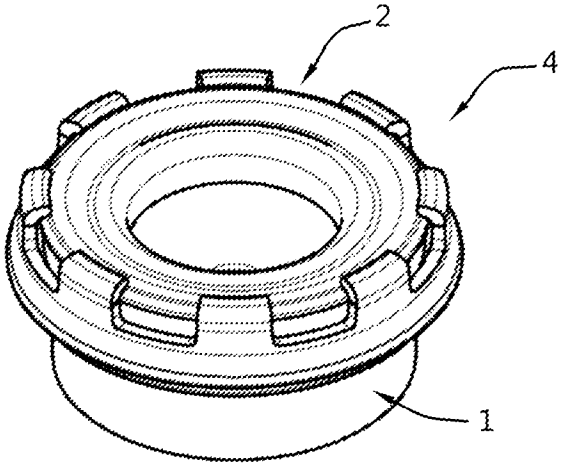
FIG. 11 shows in a view in perspective the assembly of FIG. 10 with the valve an the carrier ring in an assembled state.
Figure 10:
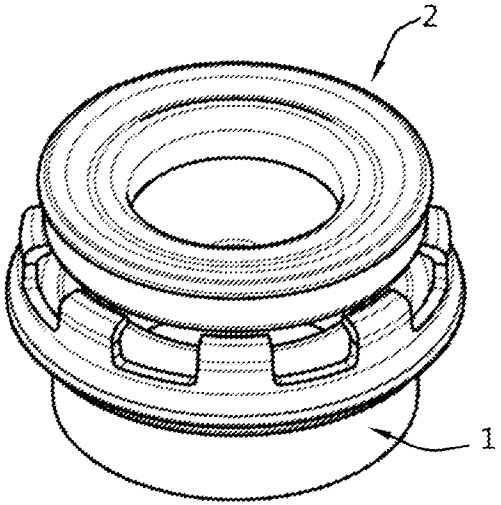
FIG. 10 shows in a view in perspective the valve carrier ring of FIG. 1 and a valve during assembly.

FIG. 5 shows a valve carrier ring 1 assembled with a self-closing valve 2. The retaining portion of the valve is indicated with reference numeral 21, the valve head with 22 and the connector sleeve with 23. The assembly of the carrier ring 1 and the valve 2 is mounted in a closure body 3 of a closure of a container.

Figure 1:
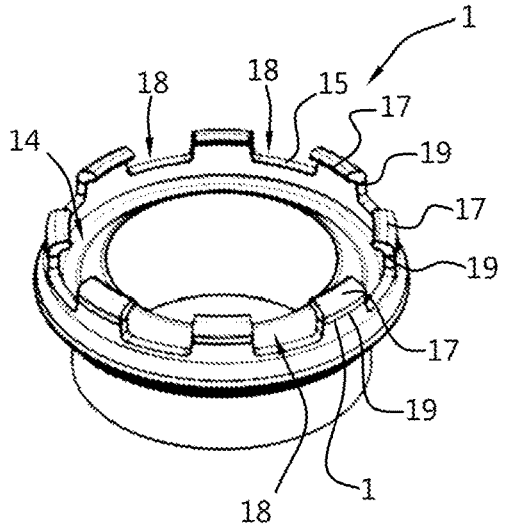
FIG. 1 shows a view in perspective of a preferred embodiment of a valve carrier ring according to the invention.
Figure 2:
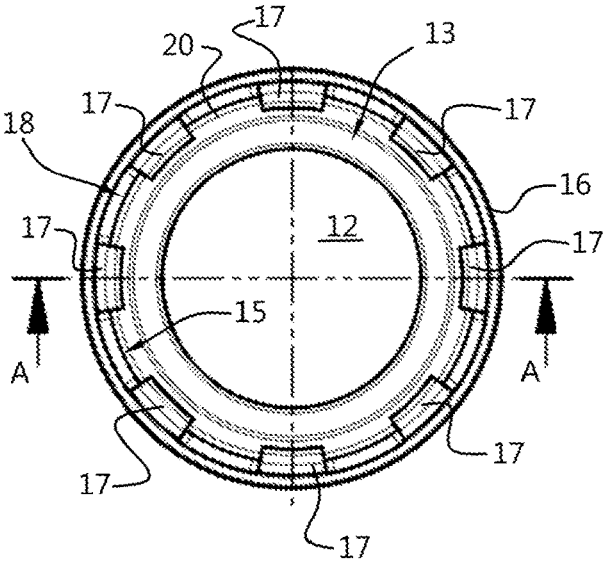
FIG. 2 shows a top elevational view of the valve carrier ring of FIG. 1.
Figure 3:
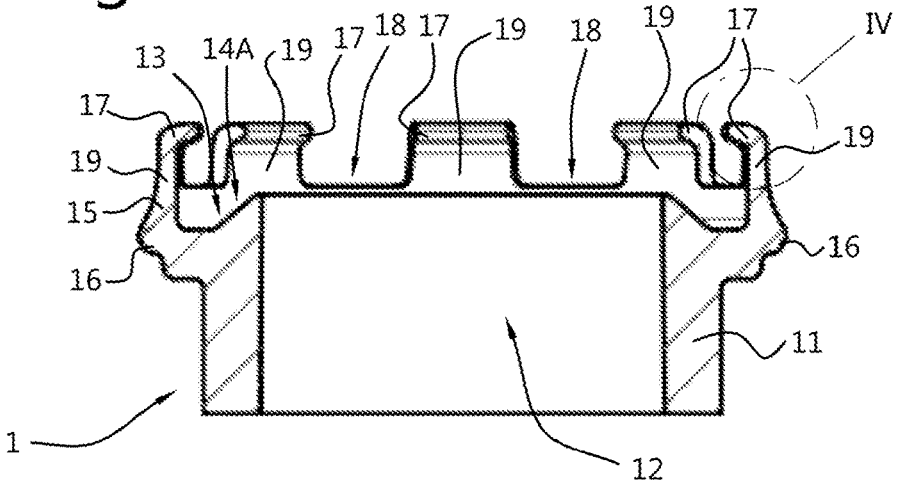
FIG. 3 shows a cross section according to A-A indicated in FIG. 2.
Figure 4:
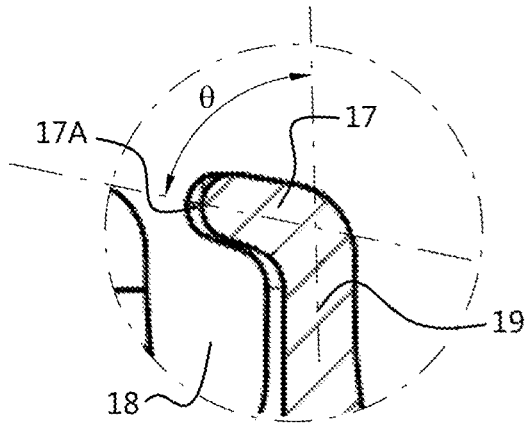
FIG. 4 shows a detail of the valve carrier ring as is indicated in FIG. 2 with IV.

In FIGS. 1-3 the valve carrier ring 1 is shown separately. This carrier ring 1 is made by injection moulding of a thermoplastic material. In particular polypropylene is a suitable material, but also other thermoplastic materials are possible to use.

The carrier ring 1 comprises a tubular wall 11 which defines a dispensing passage 12. At one end of the tubular wall 11 the carrier ring 1 has an annular seat portion 13 for accommodating the retaining portion 21 of the valve (cf. FIG. 5). The seat portion 13 comprises a support surface 14 for supporting the retaining portion 21 of the valve 2 and a circumferential wall 15 located radially outwards of the support surface 14. The circumferential wall 15 extends coaxially with the support surface 14.

The support surface 14 includes a frusto-conical surface portion 14A facing the inside of the circumferential wall 15. The retaining portion 21 of the valve 2 has a complementary frusto-conical surface 21A (cf. FIG. 12A), which in the mounted state in the closure body is clamped against the surface 14A and provides a sealing engagement (cf. FIG. 5).

The circumferential wall 15 has a circumferential snap bead 16 formed on the outside thereof. The snap bead 16 is configured and arranged to cooperate with a snap rim 31 or other snap means that is formed in the closure body 3. The snap bead 16 is in the mounted state of the carrier ring 1 in a sealing engagement with the surface of the closure body 3 as can be seen in FIG. 5.

A number of flexible lips 17 is formed on an end region of the circumferential wall 15. In the specific embodiment shown in FIGS. 1-3 there are eight flexible lips 17. The lips 17 are formed as extremities of the circumferential wall 15 with an inclined inward orientation.

In the specific embodiment of FIGS. 1-4 the circumferential wall 15 is formed having recesses 18 in the wall portions between the lips 17. Thereby the circumferential wall 15 obtains a sort of crown like shape comprising upwardly extending fingers 19, wherein on the extremity of the fingers 19 the flexible inclined lips 17 are formed as a sort of fingertips.

In FIGS. 6-9 is shown a different embodiment of the carrier ring 1 in which there are no recesses 18 in the circumferential wall 15. There are thus no fingers 19 formed. The other parts are the same and identified with the same reference numerals. In general the crown shape having fingers 19 in the embodiment of FIGS. 1-4 will provide additional flexibility in the circumferential wall, which may facilitate the demoulding of the carrier ring from the injection moulding equipment.

In either embodiment the flexible extremities 17 of the circumferential wall 15 extend inwardly and are configured and arranged to retain the retaining portion 21 of the valve 2 loosely in the seat portion 13.

FIG. 12A-F illustrates how the self-closing valve 2 is mounted in the carrier ring 1 of FIG. 1.

Figures 12A, 12B, 12C, 12D, 12E, 12F:
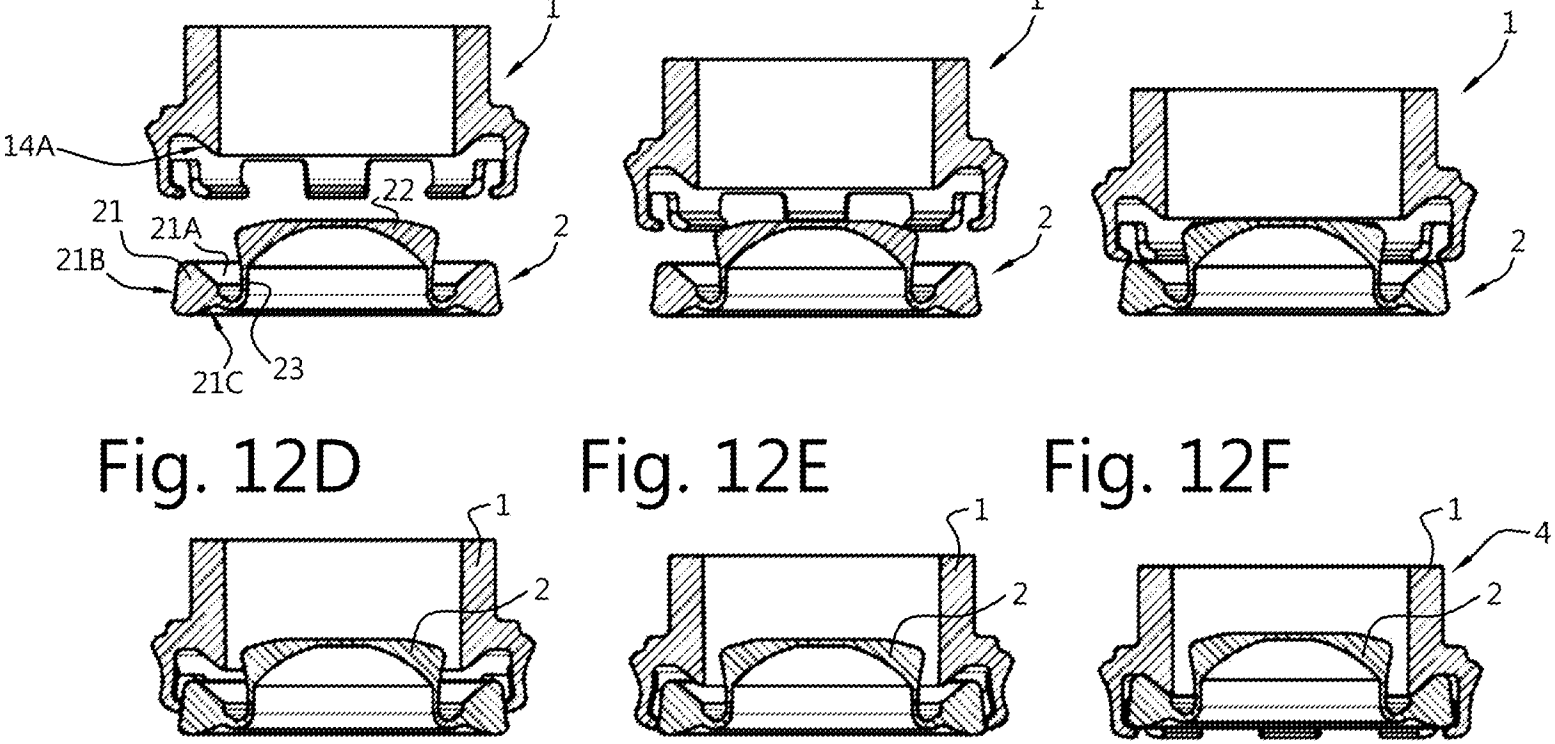
FIG. 12A-12F illustrate in a cross sectional view the steps of the assembly of the carrier ring and the valve of FIG. 10.

The retaining portion 21 of the valve 2 is formed as a ring which is thicker than the adjoining connector sleeve 23. The retaining portion 21 has a circumferential surface 21B [which in an assembled state faces the circumferential wall 15 of the carrier ring 1] having a tapering shape as can be seen in FIG. 12A, wherein is visible that the circumferential surface 21B tapers seen in the direction from the retaining portion 21 to the valve head 22, in particular in the figure from an underside to an upper side of the retaining portion 21.

The radially most inwards edge 17A of the inclined extremity, in this case lips 17, of the circumferential wall 15 of the carrier ring 1 defines a circular passage indicated by a dashed circle indicated with reference numeral 20 in FIG. 2. The circular passage is configured and arranged for inserting the retaining portion 21 of the valve 2 in the seat portion 13 of the carrier ring 1. The smallest outer diameter of the tapering circumferential surface 21B is smaller than or corresponds substantially with the diameter of said circle 20 as can be best seen in FIG. 12C. The largest outer diameter of the tapering circumferential surface 21B of the retaining portion 21 of the valve 2 is larger than the diameter of said circle 20.

The valve 2 and the valve carrier ring 1 can be easily assembled in an automated process. The valves 2 are supplied on a conveyor or holder to a predetermined position in which it. The smallest outer diameter of the tapering circumferential surface 21B is facing the carrier ring which is positioned over the valve 2 as is shown in FIG. 12A. The carrier ring 1 is orientated with the inclined extremities 17 facing the valve and is then placed over the retaining portion of the valve, preferably by automatic equipment. When the carrier ring 1 is placed over the retaining portion 21 of the valve 2 the radially most inwards edge of the inclined extremities 17 of the circumferential wall slides along the tapering circumferential surface 21B of the retaining portion of the valve as is illustrated in the FIGS. 12C-12E. The radially most inwards edge of the extremities 17 forces the retaining portion 21B, which is flexible, inwardly such that it passes into the seat portion 13 of the carrier ring. When the edge is passed beyond the edges 17A of the extremities, the retaining portion 21 of the valve 21 flexes back to its original shape and is now loosely caught in the valve seat by the undercut of the extremities 17 of the circumferential wall 15 as is shown in FIG. 12F.

The invention claimed is:

1. A valve carrier ring for carrying a self-closing dispensing valve and adapted to be assembled with a closure body of a container, wherein the self-closing dispensing valve comprises a valve head having a dispensing orifice, a peripheral retaining portion and a connecting portion interconnecting the valve head and the retaining portion, the valve carrier ring comprising an annular seat portion comprising a continuous support surface for supporting the retaining portion of the valve and a circumferential wall located radially outwards of the support surface and extending coaxially with the support surface, wherein the circumferential wall has multiple circumferentially distributed and spaced apart flexible, to an extent to be elastically deformed, inwardly inclined extremities configured as flexible lips, extending from an end region of the circumferential wall towards an edge of the extremities, wherein each of the edges of the extremities have a larger axial distance from the support surface than the end region of the circumferential wall, the extremities having an inner side providing an undercut for retaining the retaining portion of the valve in the seat portion, and wherein one or more snap beads are formed at a radial outer side of the valve carrier ring adapted to cooperate with snap means of the closure body to provide a snap connection between the valve carrier ring and the closure body.

2. The valve carrier ring according to claim 1, wherein the support surface comprises a conical surface portion facing the circumferential wall.

3. The valve carrier ring according to claim 1, wherein the support surface is adapted to form a seal with a complementary surface of the retaining portion of the valve.

4. The valve carrier ring according to claim 1, wherein the inwardly inclined extremities have an inclination angle with respect to a vertical axis of said extremities within a range of 20° to 70°.

* * * * *